United States Patent [19]

Wechter

[11] 4,351,217

[45] Sep. 28, 1982

[54] REMOVABLE TAILBLOCK

[76] Inventor: Abraham J. Wechter, 2131 Sheffield Dr., Kalamazoo, Mich. 49008

[21] Appl. No.: 128,004

[22] Filed: Mar. 7, 1980

[51] Int. Cl.[3] ..... G10D 1/08; G10D 3/00; G10H 3/18

[52] U.S. Cl. ..... 84/1.16; 84/267; 84/291; 84/329

[58] Field of Search ..... 84/1.16, 267, 291, 292, 84/329

[56] References Cited

U.S. PATENT DOCUMENTS

| | | | |
|---|---|---|---|
| 654,859 | 7/1900 | Swenson | 84/292 |
| 3,194,870 | 7/1965 | Tondreau et al. | 84/1.16 |
| 3,435,721 | 4/1969 | Dopera | 84/292 X |
| 3,524,377 | 8/1970 | Desmond | 84/267 |
| 3,550,495 | 12/1970 | Shotmeyer | 84/267 |
| 3,589,062 | 6/1971 | Desmond | 84/267 X |
| 3,696,700 | 10/1972 | Berardi | 84/291 |
| 3,781,451 | 12/1973 | Nolan | 84/1.16 |
| 3,935,782 | 2/1976 | O'Brien | 84/1.16 |

FOREIGN PATENT DOCUMENTS 1379666 10/1964 France .

*Primary Examiner*—S. J. Witkowski

*Attorney, Agent, or Firm*—Blanchard, Flynn, Thiel, Boutell & Tanis

[57] ABSTRACT

An improved guitar provided with a removable tailblock assembly which replaces the conventional fixed interior tailblock. The tailblock assembly includes a ringlike reinforcing member which is disposed in the interior of the guitar body and extends between the top and bottom walls, and is secured to the inner face of the curved end portions of the side walls at their junction. The end portions of the side walls have notches or openings formed therein which align with the opening in the reinforcing member. A ringlike insert is fixedly positioned within these latter openings, and is fixedly secured to the guitar body, such as to the side walls. This insert defines therethrough a large opening which is aligned with the longitudinal axis of the guitar body and provides convenient access to the interior thereof. The insert has webs or seats formed adjacent the inner end thereof, and a removable plate is positioned within the insert so as to close off the opening, the plate being fixedly secured to the insert by removable fasteners.

10 Claims, 8 Drawing Figures

REMOVABLE TAILBLOCK

FIELD OF THE INVENTION

This invention relates to an improved construction for a stringed instrument, particularly an acoustical guitar, employing a removable tailblock assembly.

BACKGROUND OF THE INVENTION

Stringed instruments, and specifically acoustical guitars, require a tailblock which is mounted at the bottom of the guitar along the longitudinal axis thereof, the tailblock being securely fixed between the top and bottom walls at the junction between the lower ends of the curved side walls. This tailblock is required to provide the guitar body with means for permitting the thin top, bottom and side walls to be securely joined together, and at the same time provide the guitar body with the necessary strength and rigidity. This tailblock, which provides the guitar with the necessary balance, has also been conventionally utilized for mounting thereon the strap hanger. In the case of guitars with tailpieces for attaching the strings, similar to a violin, the tailblock helps withstand the pull of the strings, by supporting said tailpieces.

With round-hole guitars built in a conventional manner utilizing a fixed interior tailblock, as explained above, access to the interior of the guitar, such as for maintenance purposes, is extremely difficult. Normally such access is possible only by first removing the strings, whereupon an individual can then insert his hand through the hole in the sounding board in an attempt to gain access to the interior of the guitar body. Even with the strings removed, access to some internal areas is very awkward. In the case of guitars built with "f" holes instead of a single round hole, the back must usually be removed to gain more than the most limited access to the interior of the instrument. Needless to say, this makes maintaining or servicing the guitar extremely difficult.

In acoustical guitars provided with electronic sound amplification, the electronic signal is generated in three basic ways. Microphones may be located externally or fastened inside the soundbox. A second method uses a transducer element to transform vibration of the sounding board or the bridge, or pressure variation under the bridge saddle, into an electronic signal. The third method of amplifying an acoustical guitar uses an electromagnetic pickup to sense the movement of the ferrous strings through a magnetic field immediately beneath them, with a resultant generation of an electronic signal in a coil which is wound around a magnet.

In addition to a pickup or signal generator, the electronic amplification circuit usually also utilizes various additional electronic components to control the volume and tone of the electronic output. Guitars have been constructed wherein some of these electronic components have been mounted within the interior of the guitar body. Usually these components are wired together into a "harness" and are mounted through separate and appropriate apertures in the top or sides of the instrument. To provide access to these electronic components, they have also been mounted on a removable panel associated with the bottom wall of the guitar body, or in the alternative on a small removable panel associated with the side wall or rim. In this regard, attention is directed to guitars possessing features of this general type, as illustrated in U.S. Pat. No. 3,781,451 and French Patent No. 1,379,666.

In those guitars wherein the electronics are associated with the back wall, such as incorporating a removable back panel, this has proven undesirable since the back wall of the guitar body is an important vibrating member. Thus, mounting the electronics on the back wall, and incorporating a removable back panel into the back wall, thus seriously affects the acoustical properties of the guitar.

With respect to mounting the electronics on a removable panel associated with one of the side walls or rim, similar to that disclosed in the above-identified French patent, this type structure is also unsatisfactory since it increases the overall complexity of the guitar construction in view of the thin and delicate nature of the curved side wall, and necessitates adding additional supporting blocks, and hence mass, to the side wall or rim, which supporting blocks are also sometimes secured to the top and bottom walls. This thus increases the mass and stiffness of the rim and sometimes the sounding board, and hence reduces the desired vibration characteristics. Since the optimum guitar construction minimizes the weight and stiffness of the rim, the mounting of additional reinforcement for a removable panel on or associated with the rim is hence undesired. Further, this location of the removable panel does not provide the most convenient access to the interior of the guitar body, particularly when access to the headblock is necessary.

The present invention thus relates to an improvement in stringed instruments, particularly acoustical guitars, which improvement overcomes the disadvantages associated with known guitars of the above-described type.

In the present invention, there is provided an improved stringed instrument, specifically an acoustical guitar, which utilizes a removable tailblock assembly to provide the necessary constructional features required to permit construction of the guitar, and at the same time to provide simple and convenient access to the total interior of the guitar body for permitting required adjustment or maintenance in a simple and efficient manner. This removable tailblock assembly permits an individual to readily insert his hand and arm into the interior of the guitar body so that the interior bracing or the headblock can be conveniently adjusted or serviced. This adjustment and access is possible without requiring removal of the guitar strings. The removable tailblock assembly also facilitates the mounting of electronic components therein in situations where electronic amplification of the sound is desired. The electronic components are mounted directly on the inner surface of a removable tail plate, so that the electronics can be easily serviced and maintained. The removable tailblock assembly of this invention provides the guitar with the required strength and balance, and the required constructional convenience, and at the same time provides greatly improved access to the interior of the guitar and access to desired electronic components. By providing this access through use of a removable tail plate, the removable component (namely the tail plate) is disposed at a location on the guitar body which is not critical from the standpoint of its acoustical characteristics. Since the tailblock must be present in a guitar to provide a gluing surface for joining the top, back and side walls, to provide reinforcement for the end pin (from which the instrument is commonly supported by a shoulder strap), and in the case of a guitar whose strings are anchored on a tail piece, to provide reinforcement for the tail piece, the construction of this tailblock to permit mounting of a removable tail plate does not in any way increase the weight or the contact surface of the tailblock with the top and back beyond what is normally required. In the case that electronic components are mounted to the tail plate, these components are mounted to the instrument in the least damaging way acoustically, as they are mounted in an existing structure that is normally acoustically "dead" anyway. The present invention thus provides greatly improved access to the interior of the guitar body, and also provides greatly improved access to any interior electronic components if same are utilized, without affecting either the construction, structure, appearance or acoustical characteristics of the guitar.

In the improved guitar of the present invention, same is provided with a removable tailblock assembly which replaces the conventional fixed interior tailblock. This improved tailblock assembly provides a ringlike tailblock which is disposed in the interior of the guitar body and extends between the top and bottom walls, and is secured to the inner face of the end portions of the curved side walls at their junction. The end portions of the side walls have notches or openings formed therein which align with the opening in the tailblock. A ringlike insert is fixedly positioned within these latter openings, and is fixedly secured to the guitar body, such as to the side walls. This insert defines therethrough a rather large opening which is aligned with the longitudinal axis of the guitar body and provides convenient access to the interior thereof. The insert has suitable webs or seats formed adjacent the inner end thereof, and a removable panel or tail plate is positioned within the insert so as to close off the opening, the tail plate being fixedly secured to the insert by means of a fastener, such as screws or the like. The removable tail plate mounts thereon a conventional strap holder. Further, electronic components can be fixedly mounted on the interior face of the removable tail plate so that, by removing the plate, the electronic components are readily accessible and servicable at a location exterior of the guitar body.

The structure of the present invention, including other objects and purposes thereof, will be apparent upon reading the following specification and inspecting the accompanying drawings.

Figure 1:
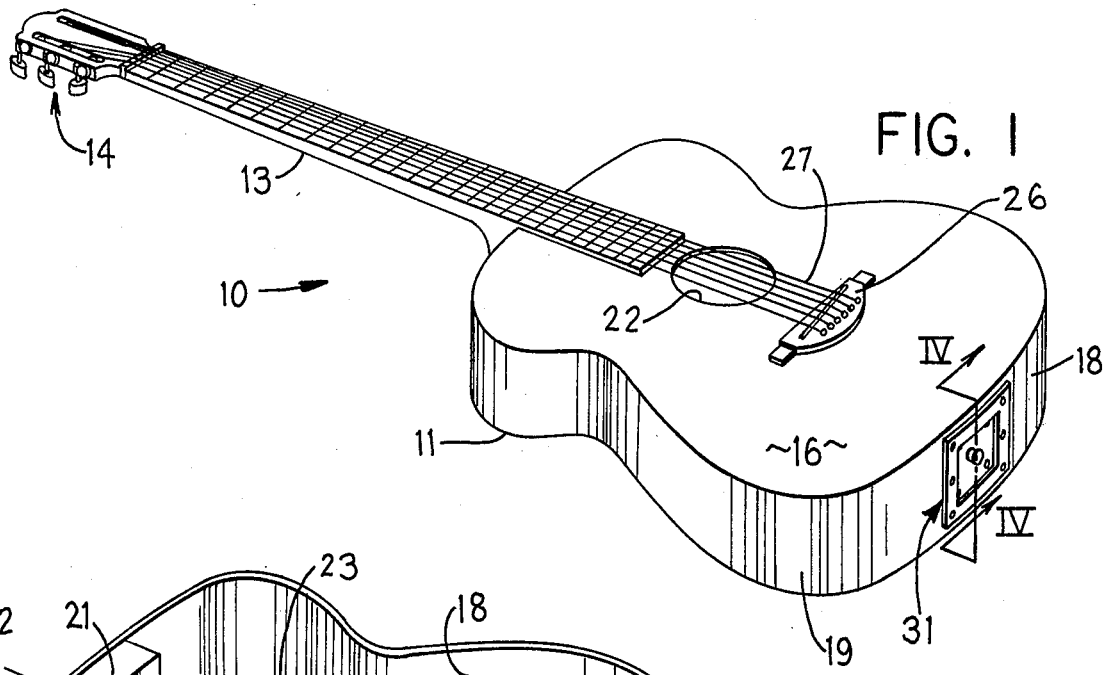
FIG. 1 is a perspective view of a conventional roundhole acoustical guitar incorporating therein a removable tailblock assembly according to the present invention.

Certain terminology will be used in the following description for convenience in reference only, and will not be limiting. For example, the words "upwardly", "downwardly", and "rightwardly" and "leftwardly" will refer to directions in the drawings to which reference is made. The words "inwardly" and "outwardly" will refer to directions toward and away from, respectively, the geometric center of the guitar and designated components thereof. Said terminology will include the words specifically mentioned, derivatives thereof, and words of similar import.

DETAILED DESCRIPTION

Figure 2:
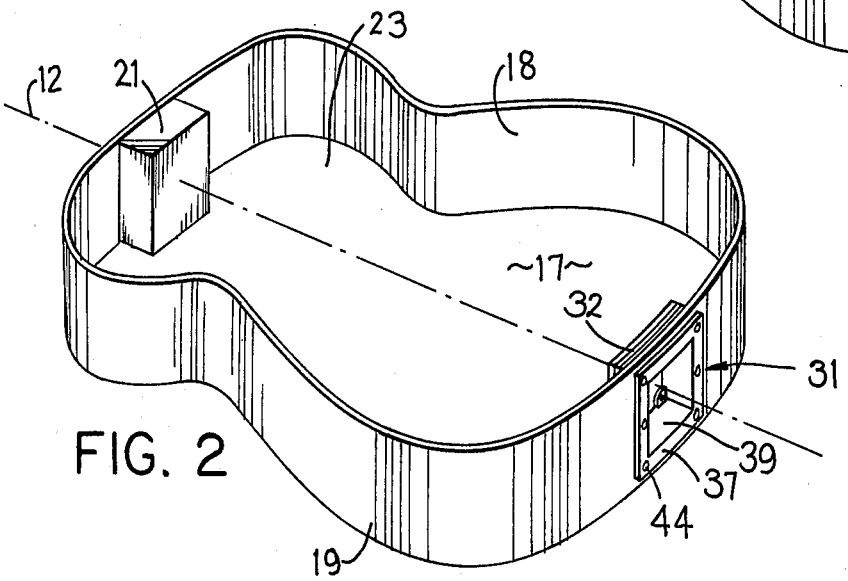
FIG. 2 is a perspective view of the guitar body with the removable tailblock assembly mounted thereon, the sounding board having been removed for clarity of illustration.

Referring to FIGS. 1 and 2, there is illustrated a stringed instrument 10, specifically an acoustical guitar. As is conventional, the guitar includes a main body section 11 which is symmetrical relative to the longitudinally-extending axis or centerline 12. A neck 13 is fixed to the head end of the body section 11 and extends outwardly therefrom in parallel relationship with the longitudinal axis 12. A conventional tuning section 14 is associated with the free end of the neck.

The body section 11 includes a generally flat top wall 16, normally referred to as the sounding board, disposed in approximate parallel relationship with a bottom wall 17. The top and bottom walls are joined together by a thin curved rim or side wall, the latter being formed by opposed side wall portions 18 and 19 which are substantially mirror images of one another and are located on opposite sides of the longitudinal axis 12.

The body section 11 is provided with a headblock 21 disposed in the interior thereof, this headblock being provided for permitting construction of the guitar and for providing the required strength. The headblock, as is conventional, is located on the longitudinal axis 12 and fixedly extends between the top and bottom walls, and is fixed to the interior surfaces of the side wall portions 18 and 19 at the junction of the upper curved end portions thereof.

As is conventional, the sounding board 16 is provided with a central hole 22 therein over which passes the guitar strings 27. The hole 22 provides communication with the interior 23 of the guitar body. The sounding board has the bridge 26 secured thereto in a conventional manner, and the strings 27 extend between the bridge 26 and the tuning section 14.

The structure of the guitar 10, as described above, is substantially conventional so that further description thereof is believed unnecessary.

According to the present invention, the guitar 10 is provided with a removable tailblock assembly 31 associated therewith, which assembly replaces the conventional fixed tailblock equivalent to the disclosed headblock 21. This removable tailblock assembly 31 is described hereinafter with particular reference to FIGS. 2–4.

Figure 4:
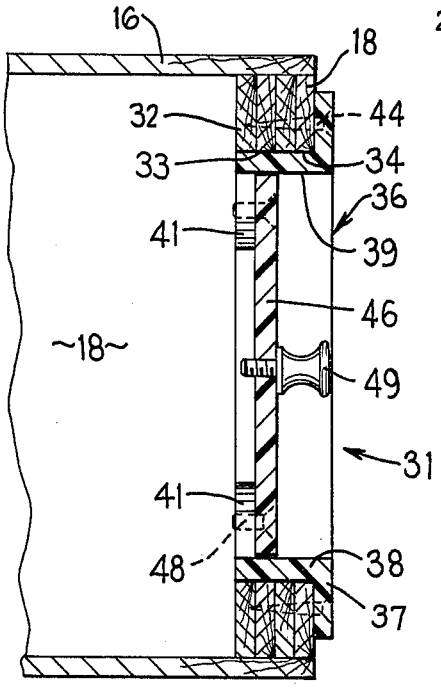
FIG. 4 is a fragmentary central sectional view illustrating the removable tailblock assembly, this view being taken substantially along line IV—IV in FIG. 1.

The tailblock assembly 31 includes a ringlike reinforcing member or tailblock 32 which is positioned within the interior of the guitar body directly at the junction between the abutting end portions of the side walls 18 and 19. This tailblock 32 overlaps and is fixedly secured to the inner surfaces of the side walls 18 and 19, and is also of suitable vertical height so as to extend between and is suitably bonded to the interior sides of the top and bottom walls 16 and 17, substantially as illustrated by FIG. 4. This tailblock 32 is preferably formed of a laminated construction and is provided with a curvature corresponding to that defined by the rim or side walls. A rather large rectangular opening 33 extends through the tailblock 32, which opening is aligned with and overlapped by suitable openings 34 which are formed in the curved end portions of the side walls 18 and 19. A ringlike insert 36 is positioned within the openings 33–34 and is suitably fixed connected to the guitar body.

The insert 36, as illustrated, preferably has a substantially rectangular exterior flange 37 which overlaps the side walls 18–19 in surrounding relationship to the opening 34. This outer flange 37 terminates in an inwardly directed flange 38 which defines a rectangular tube of short extent, this flange 38 projecting inwardly toward the interior of the guitar body and being seated within the openings 33–34. This inwardly directed flange or tube 38 thus defines a rather large rectangular opening 39 which thus extends through the rim of the guitar, substantially in alignment with the longitudinal axis 12, to thereby provide access to the interior 23.

The inner end of the tube 38 has a plurality of seats 41 formed thereon, which seats in the illustrated embodiment are defined by four small planar webs located in the corners of the tube 38 adjacent the inner end thereof. These webs 41 each have a small hole 42 therethrough for a purpose to be explained hereinafter.

The insert 36 is, in the illustrated embodiment, fixed to the guitar body by means of several holes 43 formed in the outer flange 37, whereby conventional screws 44 project through these holes and are suitably engaged with the underlying side walls 18–19 and the tailblock 32, as illustrated by FIG. 4.

The insert 36 is preferably constructed of a synthetic resin material, such as by being molded from a plastics material. This thus enables the insert to be readily formed in a simple and efficient manner, and readily provided with the desired curvature or configuration necessary in order to conform with the shape and contour of the guitar rim.

Tailblock assembly 31 also includes a removable access or tail plate 46, which plate is of a substantially flat and rectangular configuration, and is sized so as to conveniently fit within the opening 39 defined by the insert 36. This plate 46, when positioned within the opening 39, bears against the seats or webs 41. Suitable fastening elements such as conventional screws 48 extend through openings 47 located in the corners of the plate 46, and are engaged with the openings 42 associated with the webs 41, to thereby fixedly secure the plate 46 in position within the opening 39.

The plate 46 can be provided with a conventional strap holder 49 mounted thereon, which strap holder 49 will in many instances be located centrally of the plate substantially in alignment with the longitudinal axis 12.

When the guitar 10 is provided with a tailblock assembly 31 according to the present invention, substantially as illustrated by FIGS. 1–4, there is thus provided a tailblock 32 which provides the necessary strength and rigidity for permitting the top, bottom and side walls of the guitar to be properly assembled during the initial construction of the guitar. At the same time, the provision of the removable tail plate 46, which plate can be easily removed merely by removal of the screws 48, thus provides a rather large access opening 39 which extends directly through the tailblock 32 substantially in longitudinal alignment with the longitudinal axis 12. The size and location of this access opening 39 thus permits an individual to easily insert his hand and arm through the opening 39 into the interior 23 of the guitar body, whereby an individual can thus readily reach the complete interior of the guitar body, including the interior bracing and the region of the headblock. Service and maintenance within the interior of the guitar body is thus greatly facilitated, and at the same time this service and maintenance can be carried out without requiring removal of the strings. Further, the removable tailblock assembly, and particularly the provision of the removable access plate 46 and its association with the access opening 39, does not seriously affect the overall appearance of the guitar, and more particularly does not affect the acoustical characteristics of the guitar since this access capability is provided in that region of the guitar which is acoustically dead.

Figure 5:
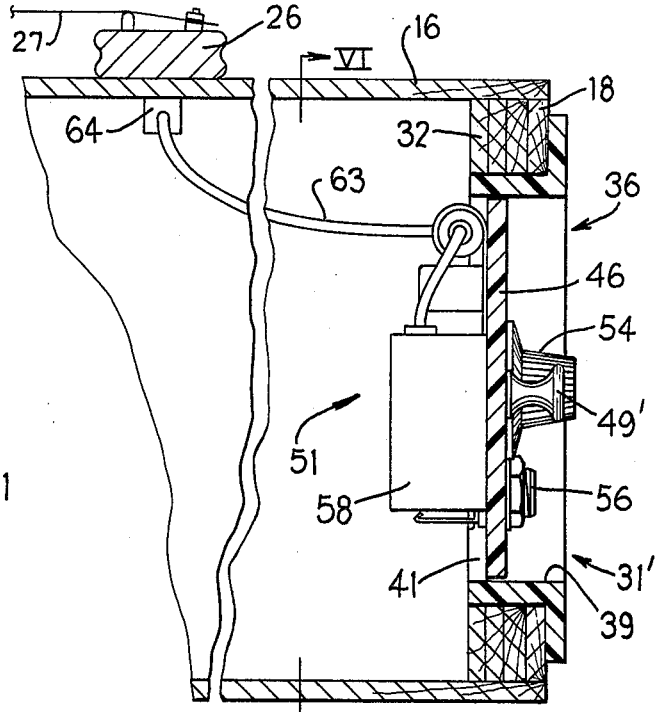
FIG. 5 is a view similar to FIG. 4 but illustrating a variation wherein the guitar is provided with suitable electronic components for permitting sound amplification.
Figure 6:
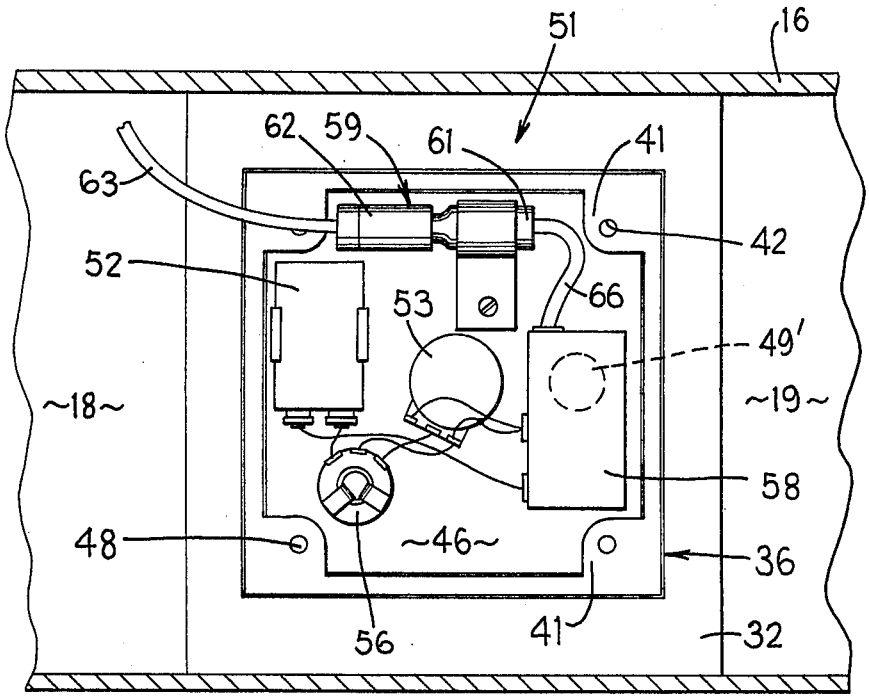
FIG. 6 is an inside elevational view as taken substantially along line VI—VI in FIG. 5.
Figure 7:
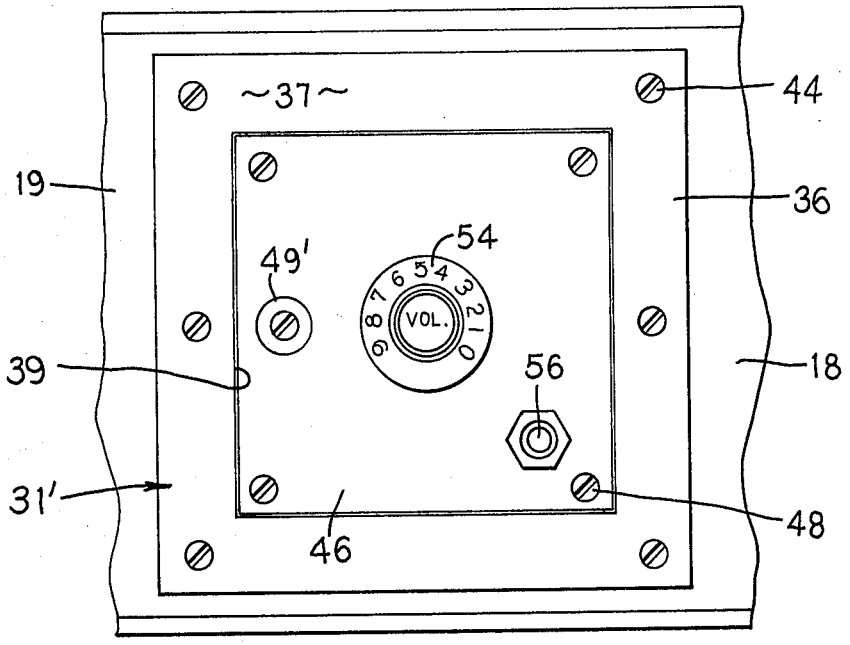
FIG. 7 is an exterior elevational view as taken from the right side of FIG. 5.

Referring now to FIGS. 5–7, there is illustrated a variation wherein the guitar is again provided with the removable tailblock assembly of the present invention, and in addition is provided with electronics positioned interiorly of the guitar for amplifying the acoustics. In this variation shown by FIGS. 5–7, the removable tailblock assembly 31' is identical to the assembly 31 illustrated in FIGS. 1–4, so that the same reference numerals are utilized in FIGS. 5–7 to designate the corresponding parts illustrated by FIGS. 1–4.

As illustrated by FIGS. 5 and 6, this variation provides suitable electronics 51 mounted on the access plate 46, which electronics permit amplifying, contouring or modifying of the sound produced by the guitar. Much of the electronics is mounted within the interior of the guitar body, specifically by being mounted on the inner side of the access plate 46, so as to not destroy either the appearance or acoustical properties of the guitar, while at the same time permitting the electronic components to be located as close as possible to the pickup.

For purposes of illustration, the electronics 51 include a small D.C. battery 52 which is suitably removably mounted on the inner side of the access plate 46. There is also provided a conventional adjustable potentiometer 53 mounted on the inner side of the access plate 46, the control shaft of this potentiometer projecting through the access plate and having a suitable manually rotatable knob 54 associated therewith and positioned adjacent the exterior side of the access plate so as to permit the volume to be readily adjusted. A conventional jack 56 is also mounted on the access plate 46 and extends therethrough so as to permit externally located electronic components (i.e., the main amplifier) to be plugged into the guitar. Such a jack is conventional and well known, and reference is made specifically to Switchcraft jack L12B. A suitable preamplifier 58 is also mounted on the access plate adjacent the inner side thereof, this amplifier being designed as required so as to provide the necessary impedance or gain matching of the pickup/transducer plus the external amplification. The battery 52, potentiometer 53, jack 56 and amplifier 58 are suitably connected together by wires so as to define the required circuit, which circuitry provides tone modification or contouring, as is well known, and hence comprises no part of the present invention.

The electronics 51, as described above, is mounted in its entirety on the access plate 46. To permit the electronics 51 to be removed with the access plate, there is provided an in-line connector 59 which is of a separable two-part construction. This connector 59 includes a first part 61 which is fixedly mounted on the inner side of the access plate 46, the connector part 61 being electrically joined to the electronics 51 by means of the cable 66. The in-line connector 59 also includes a further connector half 62 which is free of connection to the access plate 46, but which removably plugs into the connector part 61. The separable connector part 62 is joined, through a flexible cable 63, to the pickup or transducer 64, hereinafter referred to as the pickup means, which may be mounted on the underside of the sounding board 16 in the vicinity of the bridge 26.

When it is desired to service the electronics 51, or to gain access into the interior of the guitar body, then the screws 48 are removed so as to permit the access plate 46, and the electronics 51 mounted thereon, to be removed at least a limited extent from the guitar body. This outward movement of the plate 46 is permitted due to the fact that the cable 63 is joined to the pickup means 64 possesses at least a limited amount of extra length or slack. This thus enables the plate 46 and the electronics 51 to be moved outwardly from the opening 39 through a sufficient extent so that an individual can then unplug the connector part 62 from the part 61, whereby the access plate 46 and the electronics 51 thereon is thus wholly disconnected from the guitar. The individual then has free access to the interior of the guitar body through the opening 39 if desired. Alternatively, the access plate 46 with the electronics 51 thereon can then be removed to any other desired location so as to permit servicing of the electronics.

It will be apparent that the electronics 51 may involve various numbers and types of components, and that the exact circuitry may also assume various configurations, these variations being conventional and well known in the art depending upon the characteristics of the amplification desired.

The disclosed embodiment utilizes a pickup or transducer 64 mounted beneath the sounding board. However, as recognized by those familiar with guitars, this pickup means 64 can be positioned at other locations, such as in the sound hole, in the bridge, under the saddle, etc.

While the described embodiment discloses the insert 36 being screwed to the guitar body, it will be appreciated that the insert could be secured to the guitar body utilizing numerous other techniques. For example, the insert could be bonded to the guitar body by means of an adhesive or the like. Alternately, the insert could be molded with an additional locking rim around the inner end of the tube 38, which locking rim would permit the insert to be resiliently snapped into position within the ring-shaped tailblock 32, thereby securely fixing the insert with respect to the guitar body.

Figure 3:
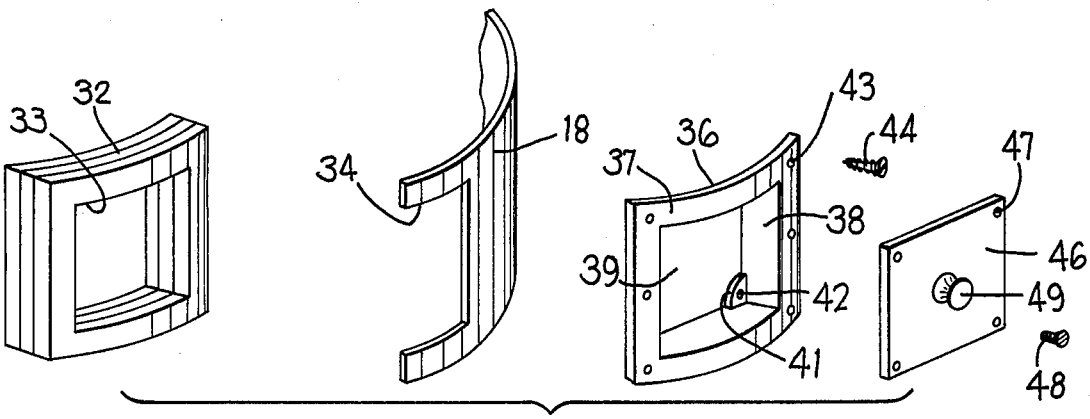
FIG. 3 is an exploded view illustrating the components of the removable tailblock assembly and their relationship to the side wall of the guitar body.
Figure 8:
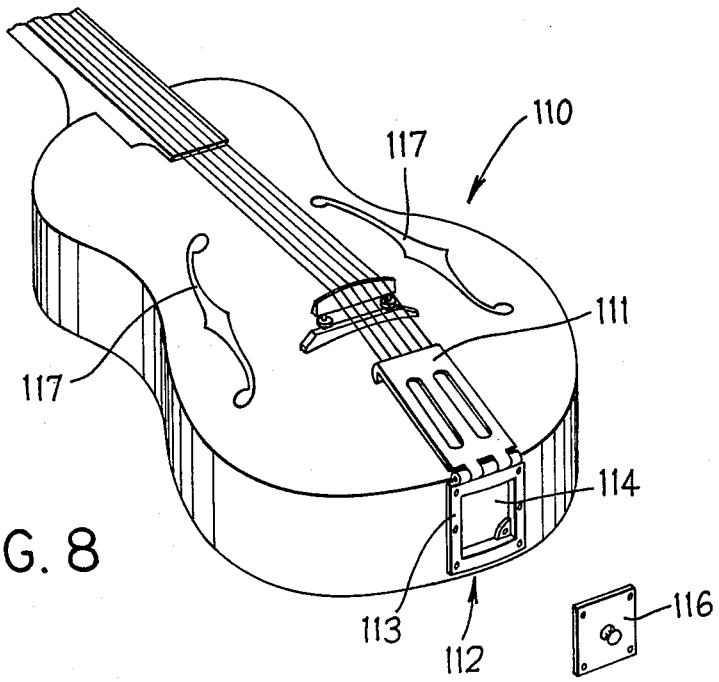
FIG. 8 is a perspective view of a conventional arched top or "f" hole acoustical guitar incorporating therein the removable tailblock assembly of this invention.

Referring now to FIG. 8, same illustrates therein another form of acoustical guitar 110, commonly referred to as an "f" hole, arched top or jazz guitar. This type guitar, rather than having the strings anchored to the bridge, has the lower end of the strings anchored to a tailpiece 111, the latter being rigidly or hingedly joined to the tailblock assembly 112 so as to withstand the stresses imposed on the guitar by the strings. In this variation, the tailblock assembly 112 is substantially equivalent to the above-described assembly 31 in that it includes an exterior ring-shaped member 113 which is fixed to the exterior rim of the guitar at the bottom end thereof in substantial alignment with the longitudinal centerline. This member 113, which corresponds to the insert 36 of FIG. 3, is fixedly anchored to an interior ring-shaped tailblock equivalent to the block 32 of FIG. 3. The side wall of the guitar, and the tailblock assembly 112, has an access opening 114 therethrough in which is fixedly but removably positioned the access or tail plate 116, the latter being substantially identical to and wholly equivalent to the above-described plate 46.

In the illustrated embodiment, the tailpiece 111 is hingedly joined to the member 113, although it will be recognized that these two pieces can be fixedly or integrally joined together if desired, such being known in the art.

The tailblock assembly 112, with its removable plate 116, is structurally and functionally equivalent to the assembly 31 described above, and hence provides convenient access to the whole interior of the guitar body. This is particularly significant with this type guitar since, as is apparent from FIG. 9, the top is not provided with a round hole, but rather is provided only with two or more narrow elongated slots 116 (commonly referred to as "f" holes) formed in the top wall, these slots conventionally being disposed adjacent the opposite sides of the guitar. With this type of guitar, access to the interior of the guitar body has thus long been a difficult, and often times impossible, task. This is particularly critical in instances where electronics are desired to be mounted within the interior of the guitar body. These difficulties are now effectively overcome when utilizing the improved tailblock assembly of this invention.

While the removable tailblock assembly of this invention, as illustrated in the drawings, is particularly desirable for use with guitars constructed of wood, it will be appreciated that this invention is also desirable for guitars of molded construction, such as guitars molded of synthetic resins. In such case, the ring-shaped tailblock can be integrally molded on the rim so as to surround the access opening.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a stringed instrument having a hollow main body forming a sound box, said hollow main body being defined by opposed top and bottom walls joined together by a side rim and having a head end and a tail end at opposed locations on said side rim, a long neck attached to said hollow main body adjacent said head end thereof and projecting outwardly therefrom in substantially parallel relationship with a longitudinal centerline which extends between said head end and said tail end of said hollow main body, a plurality of strings extending along said neck and having opposite ends thereof attached to said neck and said main body, and a tailblock fixed to said main body at said tail end thereof, said tailblock being substantially aligned with said longitudinal centerline, the improvement comprising:

a tailblock assembly associated with said main body for permitting convenient access into said hollow main body through an access opening formed in said rim and located at said tail end of said main body in substantial alignment with said longitudinal centerline, said tailblock assembly including said tailblock with the latter being of a ringlike configuration, said tailblock being fixed to said rim at said tail end of said main body in substantial alignment with said longitudinal centerline, said ringlike tailblock defining said access opening therethrough, said tailblock assembly also including an access plate removably positioned within said access opening for closing same, said ringlike tailblock and said access plate having means cooperating therebetween for fixedly stationarily positioning said access plate within said access opening, said latter means permitting said access plate to be selectively removed from said access opening.

2. An instrument according to claim 1, wherein said tailblock includes a ring-shaped reinforcing member fixedly positioned within said hollow main body, said reinforcing member extending between the top and bottom walls, said reinforcing member also being disposed so as to overlap and being fixedly connected to an inner surface of said rim, said ring-shaped reinforcing member and said rim having aligned openings therethrough in substantial alignment with said longitudinal centerline, said tailblock also including a ring-shaped insert which includes a tubular portion which is fixedly seated within the aligned openings defined by said reinforcing member and said rim, said tubular portion defining said access opening therethrough, said insert having an exterior flange which overlaps an outer surface of said rim in surrounding relationship to the opening therein.

3. An instrument according to claim 2, wherein the insert has fixedly associated therewith a plurality of substantially planar seats or webs which project inwardly from the tubular portion into the access opening adjacent the axially inner end thereof so as to define shoulders against which said access plate bears.

4. An instrument according to claim 3, wherein said cooperating means includes removable fastener means coacting between said access plate and said insert for normally fixedly maintaining said access plate within said access opening in bearing engagement with said seats, said fastening means being accessible from the exterior side of said access plate for permitting removal of said access plate from said access opening.

5. An instrument according to claim 1, including pickup means mounted on said instrument, electronic components mounted on said access plate, cable means extending between said pickup means and said electronic components, and an external connector mounted on and accessible from the exterior of said access plate for permitting externally located equipment to plug into said connector.

6. A guitar according to claim 1, including a tail piece connected to said tailblock and projecting therefrom in overlapping relationship to said top wall, and said strings having one end thereof anchored to said tail piece.

7. In an acoustical guitar having a main body defined by opposed top and bottom walls joined together by a side rim so as to define an interior chamber, said main body having a head end and a tail end, an elongated neck extending outwardly from the head end of the main body in a direction approximately parallel with a longitudinal centerline extending between said head end and said tail end of the main body, the improvement comprising a removable tailblock assembly associated with the main body at said tail end thereof in substantial alignment with said longitudinal centerline, said removable tailblock assembly including:

a ring-shaped reinforcing member fixed to an interior surface of said rim and to the opposed top and bottom walls at said tail end of said main body, said ring-shaped tailblock defining therethrough a first opening which is substantially aligned with said longitudinal centerline, said rim defining therethrough a second opening which is of substantially the same size and aligned with said first opening, a ring-shaped insert fixedly secured relative to said rim and positioned within said first and second openings, said insert including a tubular portion which is seated within and extends through said first and second openings, said tubular portion terminating in an outwardly projecting and surrounding angular flange which is positioned exteriorly of said rim and overlaps an outer surface of said rim in surrounding relationship to said second opening, the tubular portion of said insert defining an access opening which extends therethrough for providing access to said interior chamber, said access opening being substantially aligned with said longitudinal centerline, a removable access plate positioned within and substantially wholly occupying the cross section of said access opening, said access plate being manually exteriorly removable from said access opening, shoulder means coacting between said access plate and said insert for limiting the insertion of said plate into said access opening, and releasable fastening means coacting between said access plate and said insert for fixedly holding said access plate within said access opening.

8. A guitar according to claim 7, including a strap hook fixed to and projecting outwardly from said access plate.

9. A guitar according to claim 7 or claim 8, including pickup means mounted thereon, and electronic components mounted on said access plate adjacent the interior surface thereof.

10. A guitar according to claim 9, including cable means connected between said pickup means and the electronic components mounted on said access plate, said cable means having a separable connector associated therewith for permitting the access plate and the electronic components mounted thereon to be totally removed from and disconnected from said guitar, and said electronic components including connection means associated therewith and accessible from the exterior side of said access plate for permitting externally-located electronic equipment to be plugged into said guitar.

* * * * *

UNITED STATES PATENT AND TRADEMARK OFFICE

CERTIFICATE OF CORRECTION

PATENT NO. : 4 351 217

DATED : September 28, 1982

INVENTOR(S) : Abraham J. Wechter

It is certified that error appears in the above—identified patent and that said Letters Patent is hereby corrected as shown below:

Col. 10, line 13; change "tailblock" to ---reinforcing member---.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*